US005556010A

United States Patent [19]

Halm

[11] Patent Number: 5,556,010

[45] Date of Patent: Sep. 17, 1996

[54] GLUE STICK AND METHOD FOR ITS PRODUCTION

[75] Inventor: Hans Halm, Herne, Germany

[73] Assignee: UHU GmbH, Germany

[21] Appl. No.: 268,307

[22] Filed: Jun. 29, 1994

[30] Foreign Application Priority Data

Jul. 1, 1993 [DE] Germany ..... 43 21 967.5

[51] Int. Cl.[6] ..... B67D 5/42

[52] U.S. Cl. ..... 222/386; 401/171; 401/176; 222/392

[58] Field of Search ..... 222/386, 392; 401/59, 60, 171, 174, 176, 179, 181

[56] References Cited

U.S. PATENT DOCUMENTS

| | | | |
|---|---|---|---|
| 1,991,133 | 2/1935 | Babbit | 401/60 |
| 2,626,730 | 1/1953 | Gabler | 222/386 X |
| 3,168,913 | 2/1965 | Eagles | 222/386 X |
| 3,229,865 | 1/1966 | Heisler et al. | 222/392 X |
| 3,338,397 | 8/1967 | Noyack et al. | 401/60 X |
| 3,708,236 | 1/1973 | Greenwood | 401/60 |
| 3,912,403 | 10/1975 | Gjerloff | 401/171 X |
| 4,778,300 | 10/1988 | French et al. | 401/59 X |
| 4,915,527 | 4/1990 | Asano et al. | 401/60 |
| 4,960,024 | 10/1990 | Holcomb | 222/386 X |
| 5,062,551 | 11/1991 | Goldstein et al. | 222/392 X |

FOREIGN PATENT DOCUMENTS

| | | | |
|---|---|---|---|
| 950889 | 10/1949 | France | 401/59 |

*Primary Examiner*—Andres Kashnikow
*Assistant Examiner*—Kenneth Bomberg
*Attorney, Agent, or Firm*—Graham & James LLP

[57] ABSTRACT

A glue stick with a piston supporting the stick substance and a shell surrounding the stick substance is disclosed. A drive mechanism for up and down movement of the stick substance is formed in the nature of a piston connecting rod coupled to the piston, which at the other end is coupled to an actuating element which can be actuated from outside the shell. The drive element can be formed as a rod (2, a, 30, 40, 52) or as a flexible band (2C). The actuating element can be formed as a double ring (3), as a toggle joint (17), as a tongue shaped double wheel (32), as a wheel (41), or as a semi-circular solid wheel (53). preferably formed as a one-piece injection moulding. For assembly of the glue stick is pushed in to the shell from the open side, and then the glue stick substance is poured from above into the hollow space of the shell, becoming anchored on or in the piston when it set.

9 Claims, 6 Drawing Sheets

FIG. 5
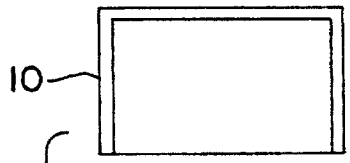
FIG. 4
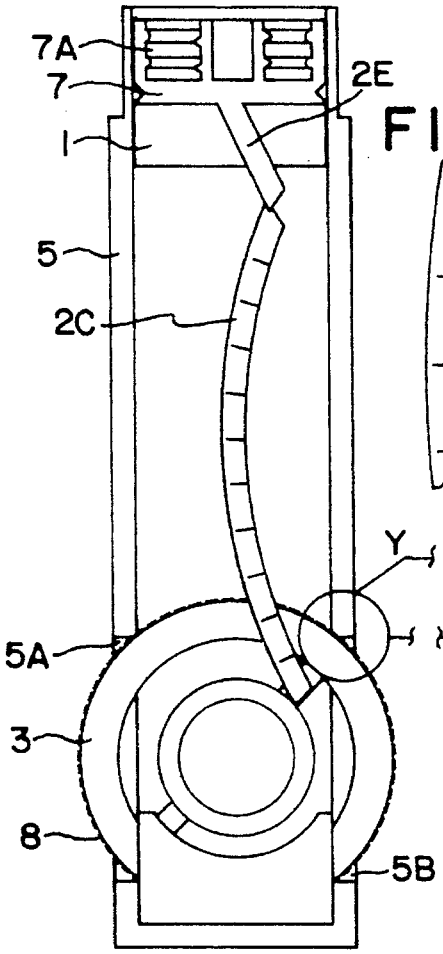
FIG. 8
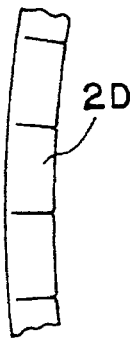
FIG. 9
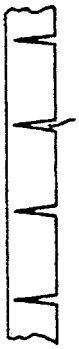
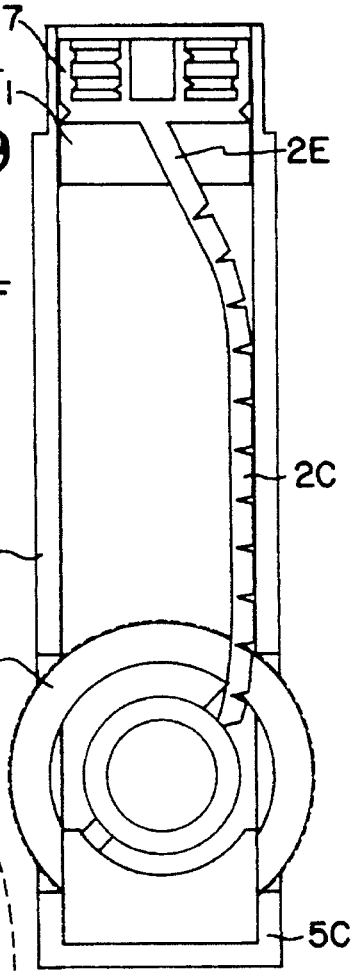
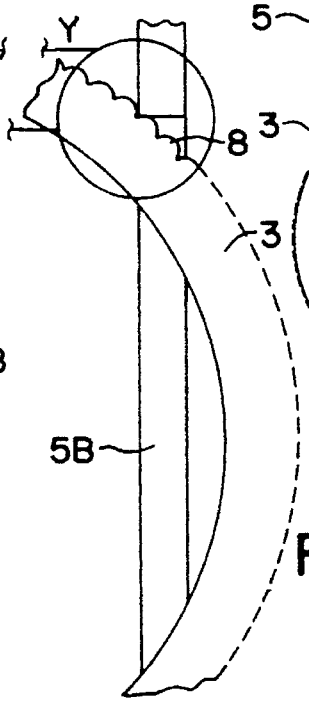
FIG. 6
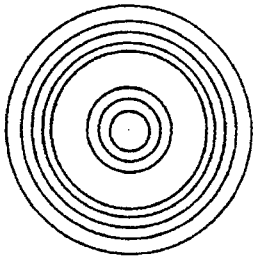
FIG. 7

53
58
52
59
57
4
55B
55C
61
55A
56A
56B
39
41
40
54
52A
36B
60
X
Z

GLUE STICK AND METHOD FOR ITS PRODUCTION

FIELD OF THE INVENTION

Background of the Invention

In the production of glue sticks of the hitherto customary kind which have a rotary base component with a rotary spindle engaging in a holding means for the stick substance, made e.g. in the form of an anchorage plate, a piston or a little basket, where the holding means fits tightly in an outer covering which protects the stick substance from drying out and damage, difficulties have been experienced in rapid assembly prior to filling of the sticks.

The outer shell, the holding means and the base component with rotary spindle are produced separately and then assembled. For assembly, the rotary spindle then has to be rapidly and very accurately turned through a central aperture in the holding means which prior thereto has been inserted in the outer shell, while at the same time the outer shell as its lower rim snaps into engagement with the base component.

Since substantial force is used, the wastage of damaged holding means and damaged rotary spindles is not negligible in economic terms, particularly also with the additional consideration of recycling of waste.

Moreover it has been shown in use of such telescopic sticks that the rotary spindle which engages in the core of the stick substance, because of the space it occupies, reduces, the usable volume of the glue substance.

Also, the length by which the stick is advanced is limited by the lift of the spindle, i.e. the greater the length which the user requires to be advanced, the greater the number of turns required of the spindle.

Also with regard to the mechanism for the stroke movement, it would be desirable to depart from the rotary movement which is translated to a double-threaded spindle.

SUMMARY OF THE INVENTION

The object of the invention therefore was to solve the above-mentioned problem of assembly and the problems of the drive mechanism.

The inventive conceptual solution is based on the idea of effecting the up and down movement of the stick by way of a drive element acting on the principle of a piston connecting rod which is coupled at one end to a holding means (piston) for the stick substance and which is coupled at its other end to an actuating element that can be actuated from outside of the shell.

SHORT DESCRIPTION OF THE DRAWINGS

Figure 3:
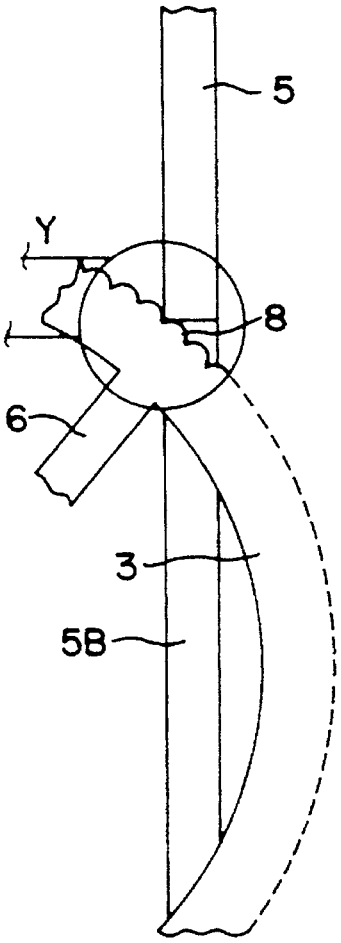

FIG. 3 explains in enlarged form the nature of the non-return means for the actuating ring.

FIGS. 4 and 5 respectively reproduce a longitudinal section through two embodiments of a fully assembled stick in which the flexible band assumes different positions.

FIG. 6 shows a top view of the stick and piston.

FIG. 7 explains the non-return means for the actuating ring.

FIG. 8 shows the flexible band with notchings in the position of FIG. 4.

FIG. 9 shows the flexible band with notchings in the position of FIG. 5.

Figures 10, 11, 11A, 12, 13, 13A, 13B, 14, 15, 16:
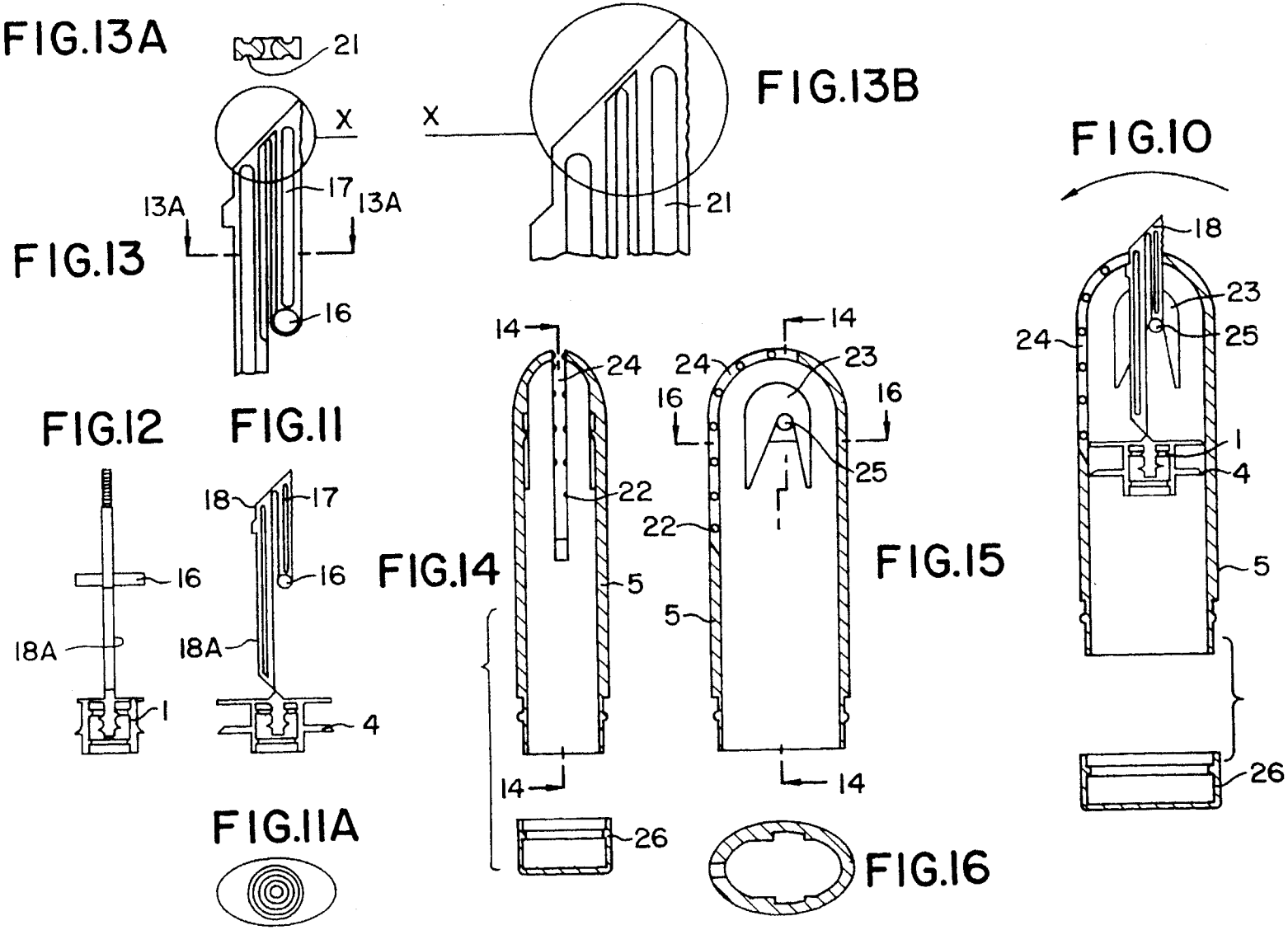

FIG. 10 shows the fully assembled glue stick in longitudinal section with the rotational direction of the actuating element indicated by an arrow.

FIG. 11 shows the drive and actuating element with the piston in longitudinal view.

FIG. 11*a* is a top view of the piston disc in an elliptical construction of the stick.

FIG. 12 shows the drive and actuating element with the piston in side view.

FIG. 13 shows the upper part of the drive and actuating element with toggle joint.

FIG. 13*a* reproduces a section A—A of FIG. 13.

FIG. 13*b* shows the detail X of FIG. 13 enlarged.

FIG. 14 shows a section C—C through the shell.

FIG. 15 shows a section B—B through the shell.

FIG. 16 shows a section D—D through the shell.

Figures 17, 18, 18A, 19, 20, 21, 22, 23, 24, 25:
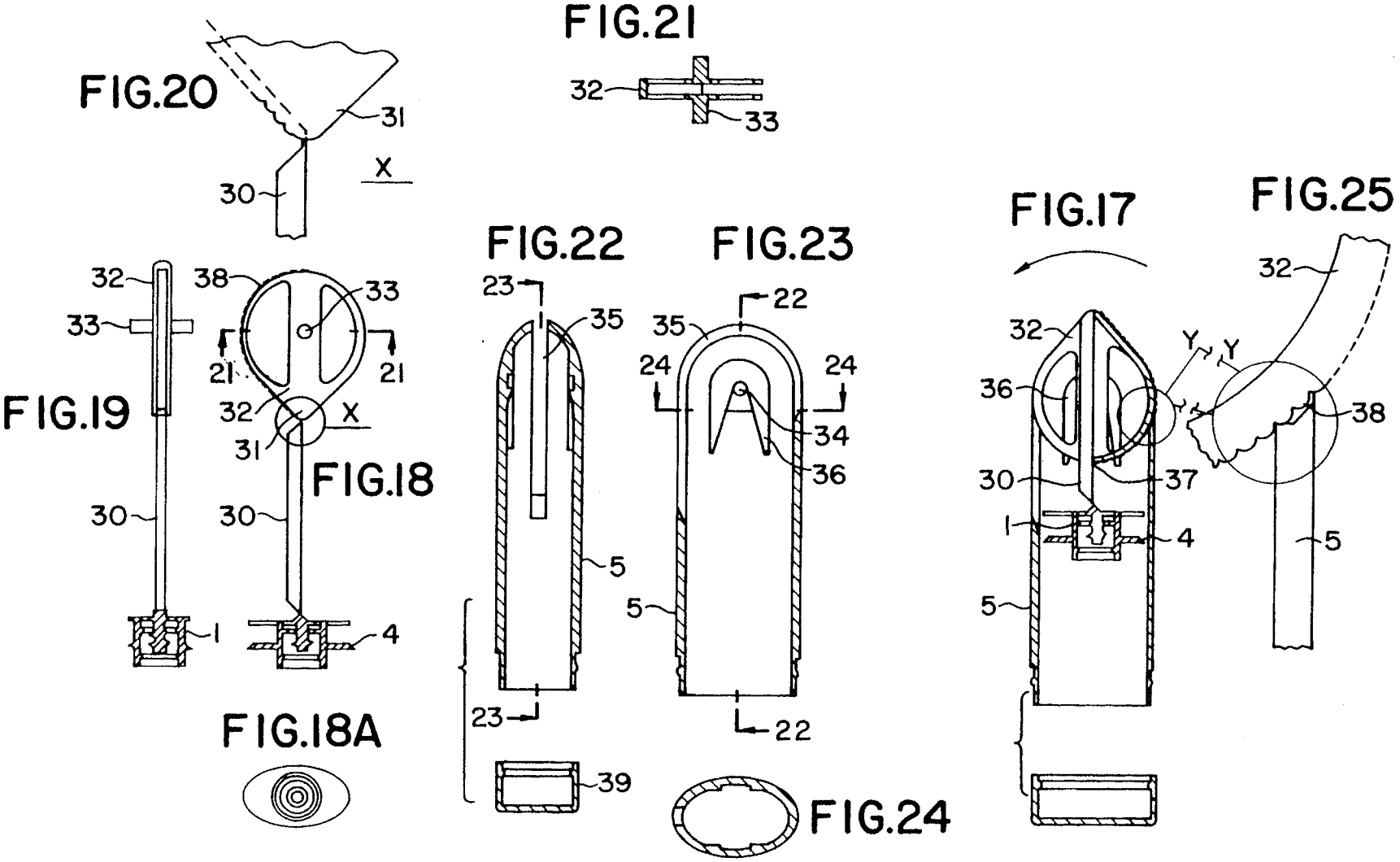

FIG. 17 shows the fully assembled glue stick in longitudinal section with the direction of rotation of the double wheel indicated by the arrow.

FIG. 18 shows the drive and actuating element with the piston in longitudinal view.

FIG. 18*a* is a top view of the piston disc in an elliptical construction of the stick.

FIG. 19 shows the drive and actuating element with the piston in side view.

FIG. 20 shows an enlargement of the coupling of the rod to the tongue shaped tip of the double wheel.

FIG. 21 shows a section D—D on FIG. 18.

FIG. 22 shows a section B—B through the shell (5) and the closure cap (39).

FIG. 23 shows a section A—A through the shell (5).

FIG. 24 shows a section C—C through FIG. 23,

FIG. 25 shows the snap mechanism of detail Y of FIG. 17 enlarged.

Figures 26, 27, 27A, 28, 29, 30, 31, 32, 33, 34:
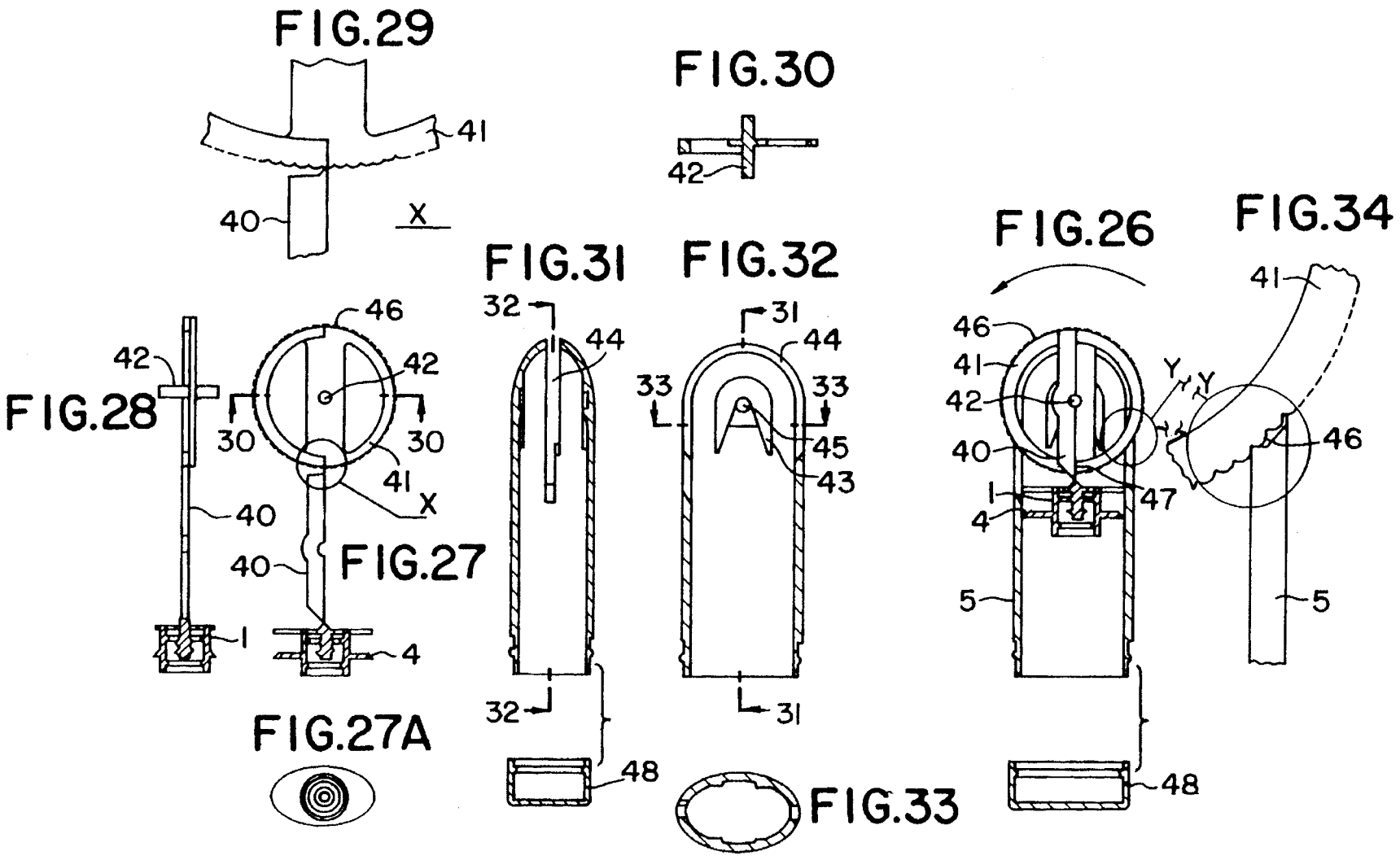

FIG. 26 shows the fully assembled glue stick in longitudinal section with the direction of rotation of the wheel indicated by the arrow.

FIG. 27 shows the drive and actuating element with the piston in longitudinal view.

FIG. 27*a* is a top view of the piston disc in an elliptical construction of the stick.

FIG. 28 shows the drive and actuating element with the piston and the transverse axle in side view.

FIG. 29 shows the coupling of the rod to the actuating wheel according to the detail X of FIG. 27 enlarged.

FIG. 30 shows a section D—D on FIG. 27.

FIG. 31 shows a section B—B through the shell (5).

FIG. 32 shows a section A—A through the shell (5).

FIG. 33 shows a section C—C through the shell (5).

FIG. 34 shows the snap mechanism of detail Y or FIG. 26 enlarged.

Figures 35, 36, 36A, 36B, 37, 38, 39, 40, 41, 42:
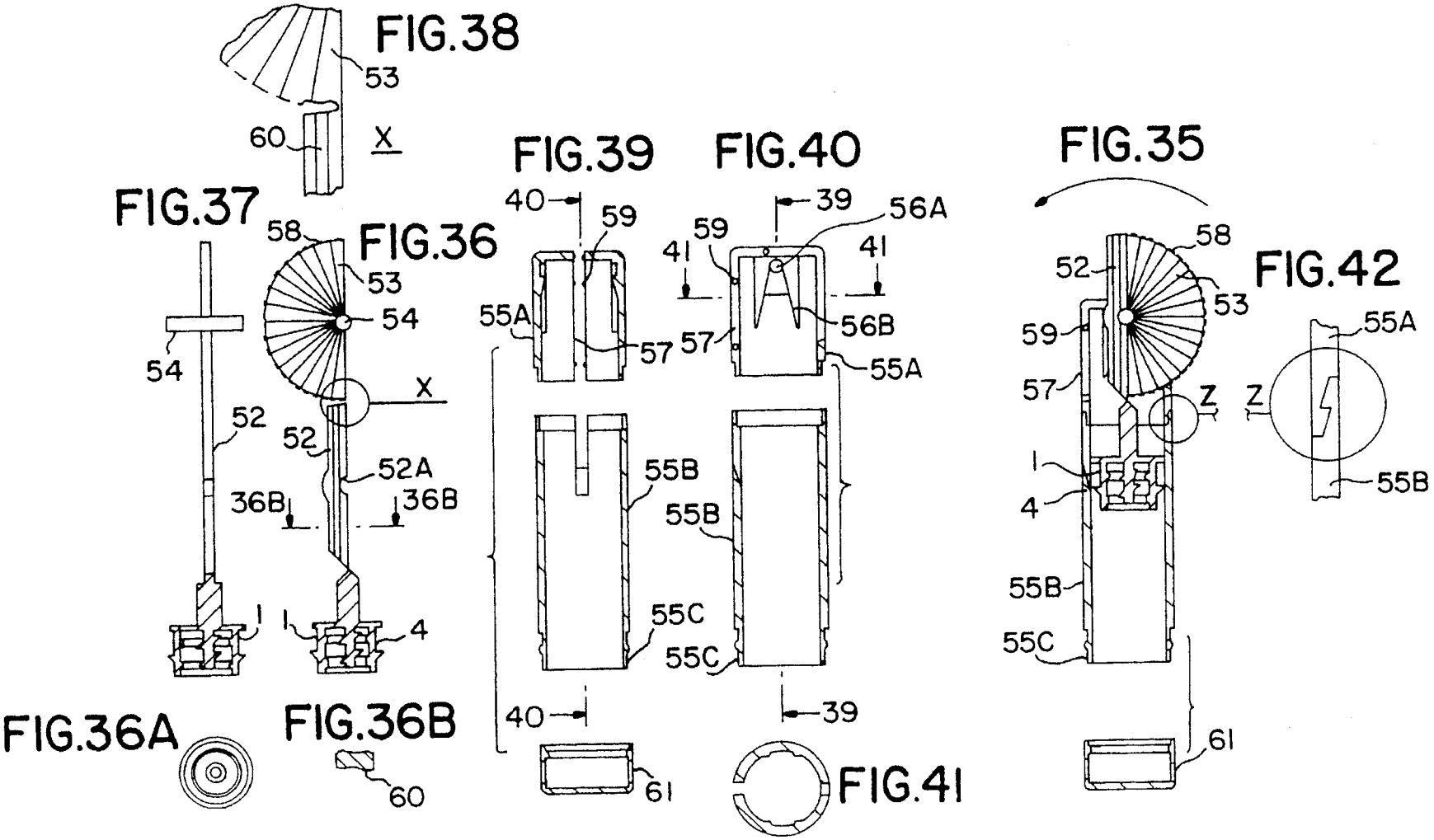

FIG. 35 shows the fully assembled glue stick in longitudinal section with the direction of rotation indicated by the arrow.

FIG. 36 shows the drive and actuating element with the piston in longitudinal.

FIG. 36*a* shows a top view onto the base of the piston.

FIG. 36*b* shows a section 36*b*—36*b* of FIG. 36.

FIG. 37 shows the drive and actuating element with the piston in side view.

FIG. 38 shows an enlargement of the coupling of the drive rod to the actuating wheel, which is formed as a fluted wheel, according to the detail X of FIG. 36.

FIG. 39 shows a section B—B through the two shell components (55A, 55B) yet to be united.

FIG. 40 shows a section A-A through the two shell components (55A, 55B) yet to be united.

FIG. 41 shows a section C—C through the shell components (55A).

FIG. 42 shows as an enlargement a form of connection between the two shell components (55A, 55B) as per detail Z of FIG. 35 enlarged.

DETAILED DESCRIPTION OF THE INVENTION

According to one embodiment which carries the inventive idea into effect, the drive element is formed as a rod coupled at one end to the base of the piston and connected at its other end by way of a coupling with an actuating element formed as a double ring which engages in two mutually opposed slits arranged at the lower end of the shell, and an abutment is provided at the periphery of the double ring.

Very desirably the double ring together with the double coupled rod and the piston acting as holding means is formed as one-piece injection moulding.

Also the shell with the mutually opposed slits is formed as a one-piece injection moulding, and thus both mouldings can be produced from the same plastics material, such as polypropylene, thereby facilitating the disposal of waste and scrap.

Assembly is effected in that the injection moulding comprising the flexible double ring serving as actuating element, the double coupled rod and the piston, can be inserted into the slit shell directly from above and thus snaps into the slits.

The principle of the piston connecting rod drive also enables e.g. transverse sections of elliptical form of the outer shell, which has the advantage that deformation of the double ring during insertion is lessened. Moreover, the ring then protrudes less from the edge of the shell.

Additionally, the elliptical stick shape has the advantage for the user that depending upon the way the stick is held, a thin or a wide trace of glue can be produced at will.

The required diameter of the double ring depends on the desired length of stroke of the stick, i.e. on the length of the glue stick in question.

DETAILED DESCRIPTION OF THE DRAWINGS AND THE PREFERRED EMBODIMENTS

Figure 1:
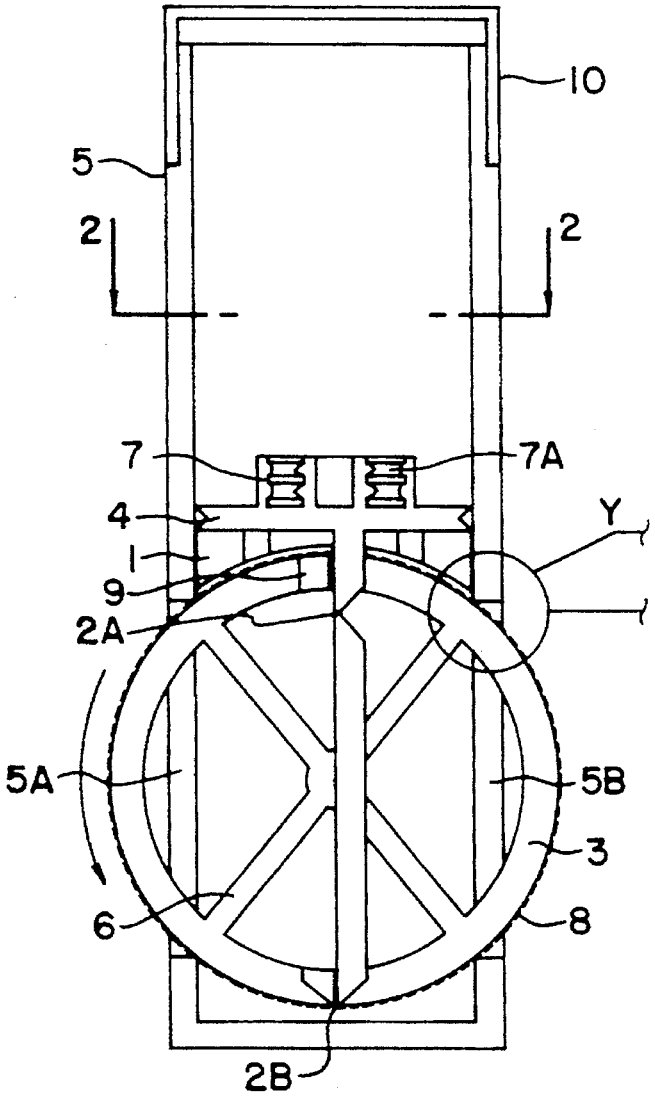
FIG. 1 depicts a section A—A through the fully assembled stick.

This embodiment will be explained more fully with reference to FIGS. 1 to 3.

The piston (1) has an anchorage element (7) for the glue substance (100) and a sealing lip (4). to the piston is coupled by way of the coupling (2A), preferably centrally, the rod (2) which acts in the manner of a piston connecting rod and which is connected at its opposite end by way of a coupling (2B) with the double wheel (3) acting as drive element. The double wheel (3) has an abutment (9) on its periphery at the apex of its starting position, so that actuation can only be in the direction of the arrow. Also, the double wheel (3) has strengthening ribs (6). It engages in the slits (5A, 5B) of the outer shell (5), which at its open end has a cap closure that protects the stick substance from drying out and is preferably formed as a push-on cap (10).

The double ring (3) is provided with transverse serrations (8) along its periphery and the notches formed by this serve as a non-return means since the upper edge of the two apertures (5A, 5B) engages with the nearest notch as shown in FIG. 3 by the detail Y.

The anchorage element (7) of the piston (1) is very desirably formed in the nature of a little basket with projections and/or retaining grooves (7A), thereby ensuring good anchorage with the fill of glue substance after it has cooled and set.

Figure 2:
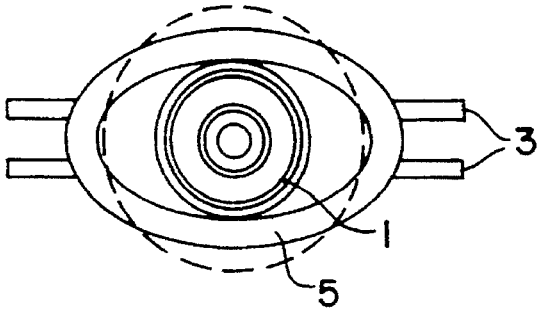
FIG. 2 shows a top view A—A.

FIG. 2 shows the section A—A of an elliptically formed stick where the mutually opposed slits (5A, 5B) are advantageously disposed in the position of the major axis of the ellipse. In FIG. 2 the broken line indicates the section of a stick of circular cross section.

According to a further preferred embodiment the drive element is formed as a flexible band which at on end is coupled to the base of the piston and at the other end is coupled, by an arrangement so that it can be wound thereon, to an actuating element made in the form of a double ring which engages in two mutually opposed slits disposed at the lower end of the shell.

Very desirably, the double ring together with the double coupled flexible band and the piston is formed as a one-piece injection moulding. Also with this embodiment, the injection moulding can be assembled with the slit shell by inserting it from above or, in the case of a different embodiment, from below.

The shell can be of circular or preferably elliptical cross section. An elliptical shape of the shell yields the advantages already mentioned above with regard to particularly easy assembly and the practical application of the glue stick.

Forming the drive element as a flexible ban moreover brings the advantage that the diameter of the double ring does not depend on the required piston stroke so that the ring diameter can be less than when the drive element is constructed as a rod. Moreover, the double ring can be carried in axial bearings.

This embodiment will be explained more fully with reference to FIGS. 4 to 9.

In the embodiment of FIG. 4 the shell receiving the drive element is formed as one piece. In the embodiment of FIG. 5 a separate base part (5C) is provided which takes care of guiding the band. Here, for assembly, the one-piece injection moulding is appropriately inserted in the shell from below, following which the base part with the band guide is inserted.

The piston (1) again has an anchorage element (7) for the glue substance which is preferably formed in the nature of a little basket with projections and/or retaining grooves (7A).

To the piston (1) there is coupled with inclined lead-in (cp. FIG. 5, 2E) the flexible band (2C) which at its other end is secured to the double ring (3) so that it can be wound thereon, the double ring engaging in the mutually opposed slots (5A, 5B) of the shell (5). The double wheel has transverse serrations (5) along its periphery in whose notches the upper edges of the apertures (5A, 5B) engage, as shown by the detail Y enlarged in FIG. 7. This constitutes a nonreturn means for the actuating element (3).

Upon rotation to propel the glue stick, the flexible band (2C) is supported against the wall of the shell (5) as shown in FIG. 5, whereby it is stiffened. The slitting from one side of the band (2D and 2F) reproduced in FIGS. 8 and 9 limits excessive bulging of the band, in case it flips over, as can be seen from FIG. 4 and FIG. 8. Thus, the flexible band is self stiffening.

The fully assembled and filled stick is closed at the open end of the shell by a cap, which desirably is formed as a push-on cap (10).

According to a third embodiment the drive element is formed as rod coupled at one end to the piston and having a toggle joint at its other end whose arm engages by way of a transverse axle in a bearing provided at the closed end of the shell, the toggle joint also acting as actuating element.

In this embodiment the shell is desirably of domed form at its closed end and has, extending from its apex, a slot or slit into which the toggle joint movably engages, and the shell is provided at the other open end with a screw-on or push-on closure.

The drive element, the actuating element (toggle joint) and the piston can desirably be produced in the form a one-piece injection moulding which can be pushed into the shell from its open end. An entry aid in the nature of a slotted guide on the inner wall of the shell helps to guide the transverse axle of the drive element so that it snaps reliably into the bearing provided in the wall of the shell.

Flutes are provided in the arm of the toggle joint which engage with nodules on the inner wall of the slot or slit of the shell, whereby a forward travel snap action means and a non-return means are realized.

The shell can be made circular or elliptical, the elliptical form having the advantages already mentioned above.

This third embodiment will be explained more fully with reference to FIGS. 10 to 16:

The drive element (18) is coupled at one end of the rod (18A) to the piston (1) which is provided with a sealing lip (4) and has an anchorage element (cp FIGS. 11 and 11*a*). The rod (18A) merges at its opposite end into a toggle joint, whose second arm (17) is connected with a transverse axle (16). The rod (18A) and the toggle joint arm (17) have flutes (21) as appears from FIGS. 13*a* and 13*b*. The outer edge of the toggle joint arm (17) can have serrations which facilitates actuation by the hand.

FIG. 14 explains the position and form of the slot (24) in the shell (5) in which the drive and actuating element engages, wherein the nodules (22) upon movement of the toggle joint engage in the flutes (21) which are there provided.

FIGS. 15 and 16 explain the operation of the entry aid (23) formed in the nature of a slotted guide, which serves to lead the transverse axle (16) securely to the bearing (25).

After the fully assembled device has been filled with glue substance, the shell (5) is provided at its open end with a screw-on or push-on closure (26).

According to a fourth embodiment the drive element is formed as a rod coupled at one end to the piston and coupled at its other end to the tip of a double wheel which to one side is formed tongue shaped and which by way of a transverse axle engages in a bearing provided at the closed end of the shell, the double wheel also serving as actuating element.

In this embodiment the shell is preferably of domed form at its closed end and has extending from its apex a slot not which the double wheel movably engages, a screw-on or push-on closure being provided at the open end of the shell.

The rod with the coupled piston and the coupled double wheel including its transverse axle, desirably form a one-piece injection moulding, which again is pushed into the shell from its open end, wherein an entry aid in the nature of a slotted guide on the inner wall of the shell takes care of guiding the transverse axle until it snaps into the bearing provided in the shell wall.

Transverse serrations are provided along at least half the periphery of the double wheel, which facilitates actuation of the wheel by the hand and at the same time acts as non-return means by snap engagement of the edge of the shell in the notches of the serrations. Moreover, an abutment is provided on the periphery of the double wheel so that the starting position after filling with the glue substance is fixed and rotation is only possible in the direction indicated by the arrow in FIG. 17.

The shell can be made circular or elliptical, the elliptical form having the advantages already indicated above.

This embodiment will be more fully explained with reference to FIGS. 17 to 25.

The drive rod (3) is coupled at one end to the piston (1) which is provided with a sealing lip (4) and has anchorage elements (cp FIGS. 18 and 18*a*). At its other end the drive rod (30) is coupled to the tip (31) of the double wheel (32) which to one side is formed tongue shaped and which by way of the transverse axle (33) engages in the bearing (34) of the shell (5).

Just as in the third embodiment of FIGS. 10 to 16, an entry aid (36) in the nature of a slotted guide on the inner wall of the shell (5) serves to guide the transverse axle (33) to the bearing (34) without tilting (cp FIGS. 23 and 24).

Transverse serrations (38) are provided along at least half the periphery of the double wheel (32), which facilitates actuation by the hand and moreover forms notches in which the edge of the shell can snap as shown in the enlargement of FIG. 25, thus forming a non-return means.

Moreover an abutment (37) is provided on the periphery of the double wheel, which fixes the starting position of the wheel so that, after filling of the stick, rotation is possible only in the direction of the arrow (cp FIG. 17).

After filling, the open she.11 component is provided with a closure (39).

According to a further embodiment, which largely corresponds to the foregoing (cp FIGS. 17 to 25), the actuating wheel is a round circle and preferably carried in an axial bearing.

The drive element is again formed as rod coupled at one end to the piston and coupled at its other end to the periphery of an actuating element formed as a wheel which by way of a transverse axle engages in a bearing provided at the closed end of the shell.

Since the actuating wheel is preferably carried in an axial bearing, it need not be largely surrounded by the shell and this presents advantages for handling of the wheel. Moreover it can be formed as a simple solid wheel.

Also in this embodiment the rod together with the coupled piston and the coupled wheel including its transverse axle, advantageously forms a one-piece injection moulding, which is pushed in to the shell from its open end, wherein an entry aid in the nature of a slotted guide on the inner wall of the shell takes over the guidance of the transverse axle until it snaps into the bearing provided in the shell wall. Extending from the apex of the shell to both sides is a slit in which the wheel engages.

Transverse serrations are desirably provided on the periphery of the wheel, which at the same time act as a non-return means as already described above in relation to FIGS. 17 to 25.

Moreover, the wheel has an enlargement on its periphery which acts as an abutment, so that the wheel can be turned in only one direction.

The shell itself can be made circular or elliptical, the elliptical form being preferred.

This embodiment will be more fully explained in the following by FIGS. 26 to 34.

The drive rod (40) is coupled at one end to the piston (1) which is provided with a sealing lip (4) and has anchorage elements (cp FIG. 27 and 27*a*).

At its other end the drive rod (4) is coupled to the periphery of the actuating wheel (41) which engages in the bearing (45) in the shell (5) by way of the transverse axle (42).

Just as in the embodiment of FIGS. 10 to 25, an entry aid (43) in the nature of a slotted guide on the inner wall of the shell (5) serves to guide the transverse axle (42) to the bearing (45) (cp FIGS. 32 and 33). The shell has a slit (44) into which the wheel (41) engages.

The wheel (41) has transverse serrations (46), where the notches between the serrations serve as a snap provision into which the upper edge of the shell (5) can snap, as depicted enlarged in FIG. 34 in the detail Y of FIG. 26.

The abutment (47) is formed by a corresponding enlargement on the wheel periphery (cp also FIG. 30 which reproduces a section through the wheel in the middle of the axle).

After filling with the stick substance, the open shell component is provided with a closure (48).

Finally, it is envisaged in a further construction of the invention to form the actuating element as a non-deformable partial or solid wheel, which however requires a different method of assembly.

In this embodiment the shell is formed in two components, where one shell component is closed at one side and at the closed end has a slot or slit extending to both sides of the apex, while the other shell component is open at both sides. The two components each have one open end formed so that it can be united with the other.

A rod acting as drive element is coupled at one end to the solid wheel and at its other end to the piston, the solid wheel having a transverse axle for engagement in a bearing provided in the closed shell component.

The combination of the rod with the coupled piston and coupled solid wheel including its transverse axle is advantageously formed as a one-piece injection moulding.

Upon assembly, such a moulding is first pushed in to the shell component which is closed at one side, until the transverse axle snaps into the bearing, an entry aid in the shell inner wall constructed in the nature of a slotted guide guiding the transverse axle to the bearing.

Subsequently, the shell end which his open at both sides is united with the other shell component, for example by a snap or screw connection or also by a welded joint.

The solid wheel is preferably formed as a fluted wheel and has transverse serrations at it periphery.

Nodules are provided on the inner wall of the slit or slot of the shell component that is closed at one side, the nodules engaging in flutes of the drive rod. In the case of a fluted wheeled, the nodules also engage in the wavy upper surface of the wheel and thus form a non-return means.

This embodiment will be more fully explained by reference to FIGS. 35 to 42:

The drive element (52) is at one end coupled to the piston (1) which has a sealing lip (4) and an anchorage element for the stick substance preferably formed in the manner of a little basket with thread projections and/or retaining grooves. At the other end the rod (52) is coupled to a semi-circular fluted wheel (53), whose axle (54) snaps into a bearing (56A) in the wall of the shell component (55A), wherein the axle is secured against tendency to topple over by the entry aid (56B) (cp FIGS. 40 and 41).

The rod (52) desirably has flutes (6) (cp FIGS. 36b and 38). If an axle bearing is provided for the wheel (53), as in the case of the embodiment shown, the drive rod must have a corresponding recess (52A).

Transverse serrations (58) are provided on the periphery of the wheel. the wheel is movably mounted in the slit (57) by way of the transverse axle (54) and the bearing (56A), the slit (57) extending to one side into the shell component (55B) which is open at both sides. By means of the nodules (59) provided on the inner wall of the slit, engagement in the flutes (60) of the drive rod (52) is made possible, whereby a non-return means is created. The length of stroke corresponds to the diameter of the wheel (53).

In this embodiment too, the cross section of the shell can be made circular or elliptical.

After filling the fully assembled device with glue substance, the open end (55C) of the shell is closed by a cap (61).

I claim:

1. A glue stick assembly fillable with a glue stick substance, having a piston for supporting the glue stick substance, a shell having a lower open end and an upper, open end, said shell configured surrounding the glue stick substance, a drive means arranged within the shell for providing up and down movement of the glue stick substance, said drive means comprising:

a connecting rod coupled to the piston at one end of said rod so as to drive the up and down movement of the glue stick substance; and a double ring having a periphery which double ring engages in two mutually opposed slits arranged at the lower end of the shell, which double ring is coupled to said rod at the other end of said rod, said double ring having an abutment at its periphery for abutting said rod, said double ring being disposed so that the double ring can be actuated from outside the shell.

2. A glue stick assembly according to claim 1, characterised in that the double ring (3) together with the connecting rod (2) and the piston (1) form a one-piece injection moulding.

3. A glue stick assembly according to claim 1, characterised in that the double ring (3) has an outer diameter greater than a diameter of the shell (5) in the position where the opposed slits (5A, 5B) are located.

4. A glue stick assembly according to claim 1, characterised in that the double ring (3) has transverse serrations (8) at its periphery.

5. A glue stick assembly according to claim 1, characterised in that the piston (1) at its upper end has a sealing lip (4) which corresponds to arm internal diameter of the shell (5).

6. A glue stick assembly according to claim 5, characterised in that the piston (1) above the sealing lip (4) has an anchorage element (7) for the glue substance, which is formed with the configuration of a basket with one of projections or retaining grooves (7A).

7. A glue stick assembly according to claim 1, characterised in that the shell (5) is one of a circular or elliptical configuration.

8. A glue stick assembly according to claim 7, wherein said shell is of elliptical configuration characterised in that the mutually opposed slits (5A, 5B) are in the position of the major axis of the elliptical configuration.

9. A glue stick assembly according to claim 1, characterised in that the shell (5) has a cap closure at its upper open end, which is adopted to be pushed the upper end.

* * * * *